United States Patent [19]

Rockola et al.

[11] Patent Number: 4,886,325

[45] Date of Patent: Dec. 12, 1989

[54] DISPLAY ASSEMBLY FOR AUTOMATIC CAN VENDING MACHINE

[75] Inventors: Donald C. Rockola, Chicago; Shuja Hague, Northbrook, both of Ill.

[73] Assignee: Rock-Ola Mfg. Corporation, Addison, Ill.

[21] Appl. No.: 245,735

[22] Filed: Sep. 16, 1988

[51] Int. Cl.[4] ..... A47F 3/00

[52] U.S. Cl. ..... 312/138.1; 312/223; 312/234.5

[58] Field of Search ..... 211/71; 312/138 A, 292, 312/117, 234.5, 234.4, 138 R, 223

[56] References Cited

U.S. PATENT DOCUMENTS

| | | | |
|---|---|---|---|
| 1,984,977 | 12/1934 | Mize | 312/138 A |
| 2,052,466 | 8/1936 | Heise et al. | 312/138 A |
| 2,131,680 | 9/1938 | Zahodiakin | 312/292 X |
| 2,371,845 | 3/1945 | Robison | 312/138 A |
| 2,851,064 | 9/1958 | McCowan | 211/71 X |
| 3,452,879 | 7/1969 | Guarino | 211/71 |
| 4,708,409 | 11/1987 | Voegeli | 312/138 A |

*Primary Examiner*—Joseph Falk

*Attorney, Agent, or Firm*—McCaleb, Lucas & Brugman

[57] ABSTRACT

An in-door mounted shadow-box type display assembly for use in can vending machines by which the various items available for selection are visually displayed to the customer and identified by indicia which coordinate with the article designating indicia of the machine's selection system. The assembly comprises a unitary frame adapted to be mounted within the interior of the vending machine's front door, behind a transparent area of the door's front panel. Plural display openings or sockets are provided in a planar display panel associated with the frame for receiving full size cans in upright display position. Such openings accept the vertical can dimension, but are smaller than the diameter thereof so that only a chordal segment of each can is exposed to customer view. Springs or similar elastic members are used to engage and hold the cans in their display openings. Translucent light shields border the mounting frame to extend forwardly of the display cans to hide the door's interior from view while serving to transmit artificial light for illuminating the display articles.

7 Claims, 2 Drawing Sheets

DISPLAY ASSEMBLY FOR AUTOMATIC CAN VENDING MACHINE

This invention relates generally to coin-operated vending machines and more particularly to improvements in means for displaying articles to be vended thereby.

In the art of vending articles by coin-operated machines, as in other merchandising media, display of items available for customer selection and purchase is most important. In can vending machines, in particular, the variety of canned products, such as beverages, available for selection is ever increasing. The familiar can vending machines usually present half a dozen or more drink selections, but current market demand for vending machines capable of dispensing 12 or more varieties of beverages has created a problem of adequate display of the available items. In addition, the ability to conveniently display the available articles to the customer and coordinate his particular selection with the machine's selection system is of paramount importance in accomplishing effective sales.

While there have been article display systems for this purpose in the past, such as that disclosed in U.S. Pat. No. 3,628,643 issued Dec. 21, 1971, such prior systems have been limited in their display capacity and have involved generally complex and costly assemblies such as that set out in the aforesaid U.S. Pat. No. 3,628,643 which incorporates the can display directly with the selector system. In other instances replica display models of the articles or printed representations thereof have been used with limited customer appeal.

The present invention provides a simple and cost effective solution for the aforenoted problems.

BRIEF SUMMARY OF INVENTION

In brief the preferred form of the present invention comprises a shadow-box type display adapted to be mounted within the front door of a vending machine cabinet and comprising a metal or other rigid material mounting frame bordering a planar display panel formed to provide a plurality of display openings, each of which is receptive of a full size actual sample canned article, such as a canned beverage. Each opening is vertically dimensioned to receive a cylindrical can in a operationally upright display position so that the same is undersupported and closely fitted into its display opening. The width of each display opening is less than the can diameter so that only a cylindrical segment or portion of the can, bearing a brand name or other identifier, projects forwardly of the display panel for customer observation. Means are provided beneath the bottom ends of the display cans to act as shock absorbing, anti-rattle dampeners which hold the cans snugly against the upper ends of the display openings and prevent rotation of the cans. Elastic means are extended transversely across the display panel behind the displayed cans to resiliently engage and hold the same in their respective display openings. The display assembly is adapted to be secured within the front door of the vending machine cabinet, opposite a transparent window of the door's front panel. In this manner the display items are visible, but securely isolated from the customer. Illumination of the display items is effected by artificial lighting within the front door of the machine cabinet and translucent light shields preferably border the mounting frame to transmit indirect light to the display and also bridge the gap or space between the display panel and the front door panel to hide the door's interior from view. Suitable indicia are provided adjacent each display item to identify the same for customer operation of the machine's selector system bearing coordinating data thereon. The display items may be readily removed from the display panel from the inside of the cabinet door so that their organization in the display may be readily revised to accommodate changes in the articles available for selection.

One of the principle objects of this invention is to provide an improved article display assembly particularly useful in automatic coin-operated vending machines adapted to dispense canned articles.

Another object of this invention is to provide a door mounted article display assembly for use in coin-operated vending machines which provides improved customer appeal, display capacity and selection identification.

Still another object of this invention is to provide an improved shadow-box article display assembly for vending machines in which the displayed articles are illuminated for customer attraction and observation.

A still further object of this invention is to provide a display assembly for use in automatic coin-operated vending machines in which various articles to be vended are coordinated with the machine's vend selection system by means of identifying indicia on the display corresponding to identifying indicia of the vend selector system.

A still further and important object of this invention is to provide an improved display assembly for use in coin-operated vending machines which is characterized by its simplicity of construction, ease of assembly and use and economies of production.

Having described this invention, the above and further objects, features and advantages thereof will be recognized by those familiar with the art from the following detailed description of a preferred embodiment thereof illustrated in the accompanying drawings and representing the best mode presently contemplated for teaching those of skill in the art to practice this invention.

IN THE DRAWINGS

Description of the Preferred Embodiment

Figure 1:
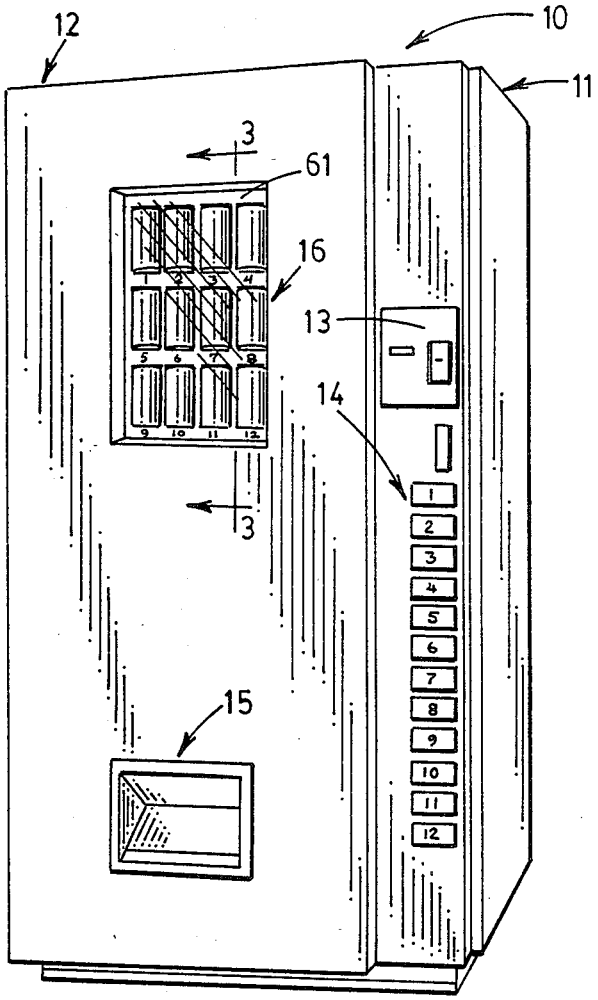
FIG. 1 is a perspective view of a automatic coin-operated vending machine incorporating the display assembly of this invention.

With reference to FIG. 1, a typical automatic coin-operated vending machine, indicated generally at 10, comprises an upright cabinet 11 having a front door 12 hinged to move horizontally relative to the cabinet and equipped with the usual coin receptor 13, selector panel 14, delivery stage 15 and the improved display assembly 16 in accordance with this invention mounted in door 12 of the vending machine cabinet.

Figure 3:
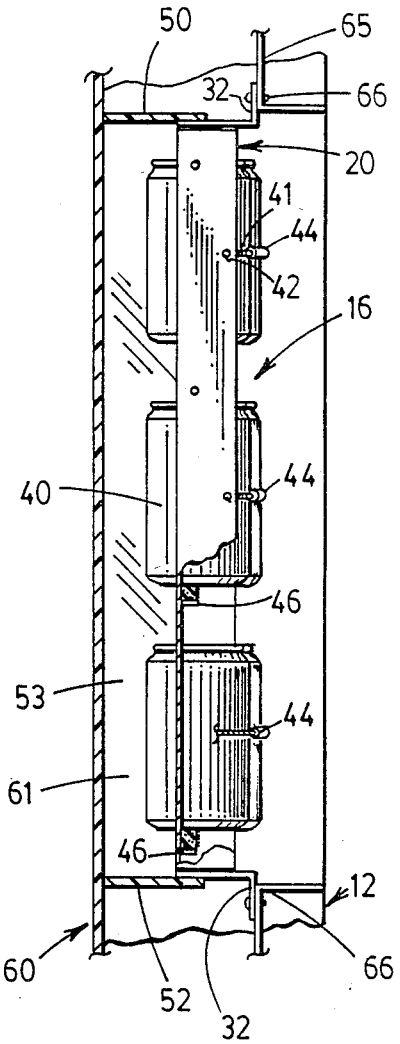
FIG. 3 is an enlarged cross sectional view taken substantially along vantage line 3—3 of FIG. 1 and looking in the direction of the arrows thereon.
Figure 4:
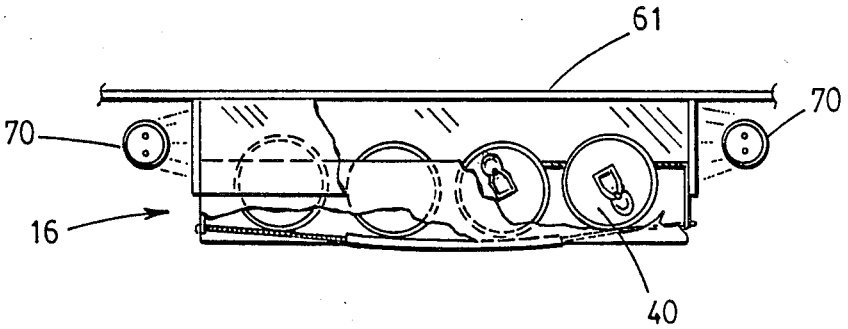
FIG. 4 is a top plan view of the display assembly shown in FIGS. 1–3.
Figure 2:
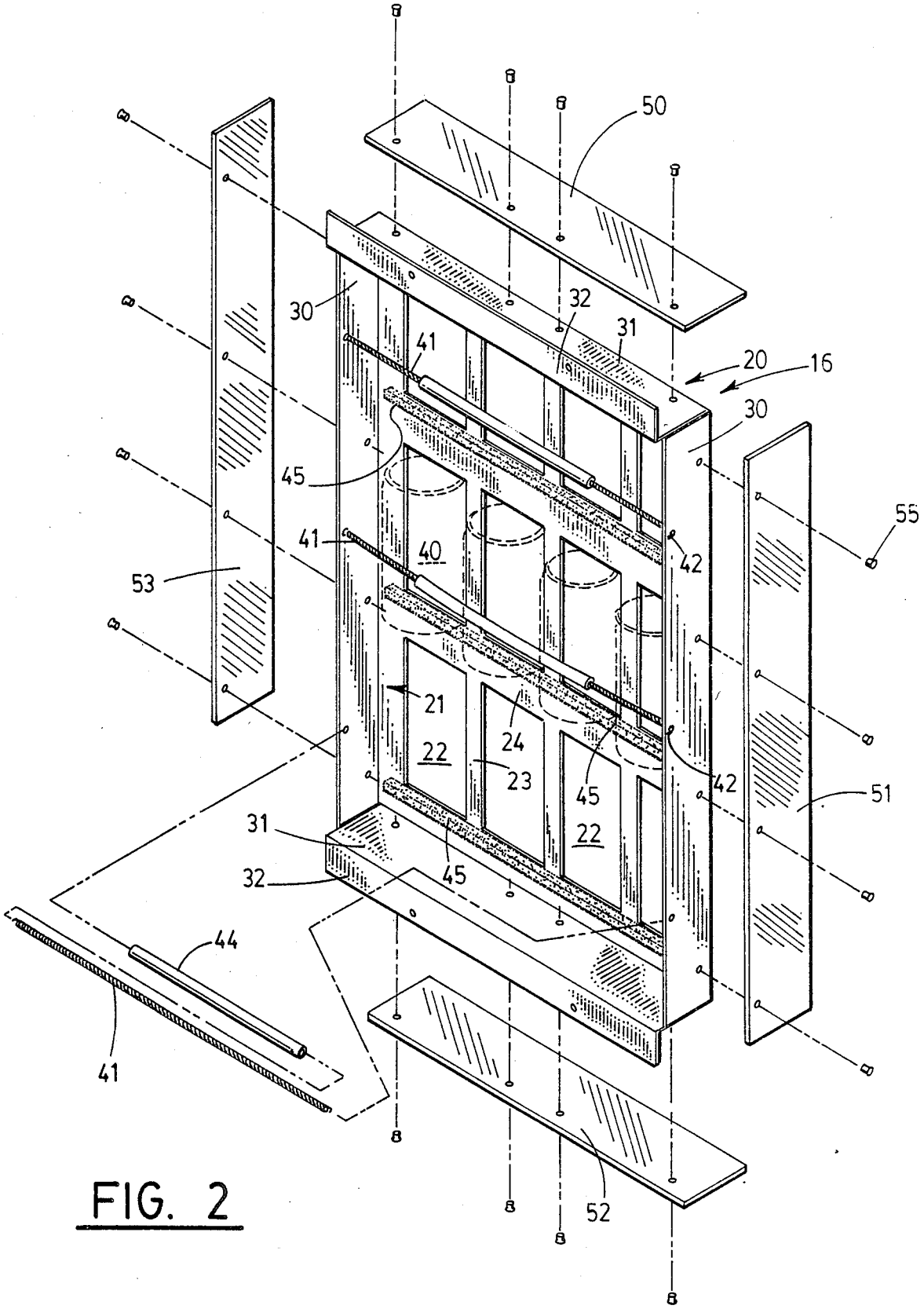
FIG. 2 is an exploded perspective view of the display assembly illustrated in FIG. 1.

With reference to FIGS. 2, 3 and 4, particulars of assembly 16 will now be set forth to illustrate features of the preferred embodiment of this invention.

As shown best in FIG. 2 of the drawings, the elemental portions of the display assembly 16 comprise a rectangular mounting frame 20 which, in this particular instance, is formed as a unitary stamping of heavy sheet metal to include a planar display panel 21 of generally rectangular configuration having a plurality of openings 22 therethrough which are separated by intervening webs of the panel 21 as indicated at 23 and 24, by way of example. The openings 22 are aligned in three horizontal rows of four openings each, with the rows being spaced vertically according to the vertical dimensions of the panel 21 and the requirements of the number of items to be displayed. In this particular illustrated instance there are twelve rectangular display openings 22, each receptive of a sample cylindrical can, such as a standard twelve fluid ounce beverage container, representing, in the norm, different beverage brands or flavors. A different number of openings and/or different shape may be employed, depending on display requirements.

It will be noted that the lateral edges or limits of the display panel 21, in the preferred illustrated case, are formed integrally with planar side frame members or panels 30, 30 of generally rectangular profile which extend along the full lateral margins of the display panel 21 and rearwardly at right angles to the plane thereof. In addition to the side frame panels the upper and lower margins of the display panel 21 are formed integrally with planar rectangular top and bottom end frame panels 31, 31 of like configuration which extend across the lateral dimensions of the display panel 21. It will be noted that the top and bottom end frames 31, 31 are of somewhat greater lateral dimension than the side frame panels 30, 30 and that each of the top and bottom panels 31, 31 is provided with a right angularly related outwardly extending mounting flange 32 at one margin. In this latter regard, it will be recognized that the mounting flanges 32 associated with the end frame panels, as viewed in FIG. 2, extend vertically upwardly and downwardly, paralleling the plane of display panel 21.

It is preferred that the display panel 21 and its side panels 30, 30 and end panels 31, 31 including the mounting flanges 32, 32 be formed as an integral unitary stamping, symmetrical about its vertical and horizontal axes as shown, so that either end thereof may be mounted upwardly in operation. It is fully contemplated however that the side and end panels may be separate from the planar display panel 21 and such portions subsequently integrated to formulate the frame 20 if that form of manufacture is preferred. Also, it is within the scope of this invention that the frame and panel be of plastic or other materials and be of shape other than rectangular.

In order to hold the several display cans, indicated at 40, tightly in display openings 22, each of the horizontal rows of openings of the display panel is traversed by a horizontally extending tension spring 41 extending between and attached to the panel or in appropriate openings 42 formed in the side panels 30, as shown in FIG. 2. To insure that all cans are tightly pressed in the display openings each spring 41 is equipped with a cylindrical sheath member 44 which serves to engage the rearward sides of the cans 40 to insure resilient pressure against the cans. This is particularly effective if only one or two openings are present in such horizontal display row.

When three or more cans are to be displayed in each horizontal row, as shown, the interior openings 22 are slightly narrower than the outboard display openings. Thus, the interior can or cans as shown in FIG. 4, project rearwardly of the display panel slightly more than the end or outboard cans in each display row. As a result the spring 41 follows a catenary curve, applying substantially uniform pressures on all cans to hold them in place.

Inasmuch as the vertical dimension of the display openings 22 is just slightly greater than that of the cylindrical cans 40 so that the latter may be conveniently and quickly inserted in place, a resilient shock pad 45 is disposed on a platform 46 turned inwardly of lower edges of the several openings 22 as shown in FIGS. 2 and 3. It has been found that synthetic sponge material is operationally satisfactory for this purpose and that the same effectively operates to resiliently engage the lower ends of the cans behind the display panel and exert sufficient upward resilient force to lightly hold the cans vertically in their display openings. The pads 45 prevent rattling and unwanted movement, particularly rotation, of the cans in the display caused by vibration of the vending machine and opening and closing movements of the door in which the display assembly is mounted.

To complete the display assembly it will be recognized from FIG. 2 that the illustrated mounting frame 20 is equipped with four planar light shield members 50, 51, 52 and 53 disposed along each of the margins of the mounting frame. In particular such shield members are fastened to the side and end panels 30, 31 of the frame to extend forwardly of the plane of the display panel 21, for reasons which will appear presently. In the herein illustrated instance, each of the display panels 50–53 is attached to its respectively associated side or end panel 30, 31 by rivet fasteners 55 or the like. It will be noted that panels 50 and 53 which are attached to the side panels 30, 30 of the mounting frame are of similar vertical or lengthwise dimension therewith and that a corresponding relationship obtains between the end shields 50, 52 and the top and bottom panels 31. Such panels preferably are of translucent material, although, they may be transparent. In either event they must be capable of transmitting light for purposes of illuminating the display.

Turning now to FIGS. 3 and 4 of the drawings, the mounted condition of the display assembly 16 will be better understood. As there shown, assembly 16 is adapted to be mounted substantially centrally of the front-to-back dimensions of the cabinet door 12 and behind a front panel 60 of the door, opposite a transparent area 61 thereof comprising a viewing window through which the display assembly 16 may be seen readily by the customer. It will be noted in this regard that the translucent or transparent shield members 50–53 extend between the mounting frame 20, more particularly, the top, bottom and side panels thereof and the inside face of the window area 61 in the door's front panel. The assembly 16 is supported rigidly between horizontal transverse frame members 65, 66 located adjacent the upper and lower ends of the assembly 16 to abut the mounting flange portions 32, 32. Suitable interconnection between the frame members 65, 66 and the mounting flange portions 32 of the mounting frame 20 is effected by bolts, rivet connectors 66 or the like.

As previously noted the light barriers or shields 50–53 affixed to the mounting frame 20 extend forwardly of the display area 21 to abutingly engage the innerface of the window panel 61 in the cabinet door 12. Thus the shields 50–53 constitute light transmitting barriers sealing the interior of the door from the viewer while at the same time permitting the transmission of light onto the forward side of the display assembly where the several cans 40 are mounted. Illumination of the interior of the described shadow box structure for display assembly 16 is effected by a pair of fluorescent tube lights 70, 70 (see FIGS. 3 and 4) or if preferred a series of incandescent lights may be used for this purpose. In either event the translucent nature of the light shields permits the entry of a soft shadow lighting across the faces of the displayed cans to give a very favorable and eye attractive appearance to the observer.

In order that the customer viewing the displayed cans in assembly 16 may effect a vend selection, it will be noted from FIG. 1 that identifying indicia, in this case numbers 1–12, are located immediately adjacent each of the display cans; such indicia being attached or affixed to the front of the display panel 21 and more specifically to the intervening horizontal web portions 24 thereof immediately below each of the cans 40 displayed. Such indicia correspond to the selection positions on the selector means 14 of the machine as shown. Thus the customer may readily associate a selected displayed article or beverage in this case with the appropriate selection button of selector means 14. After the deposit of appropriate coins in the coin deposit 13 and depressing the desired selection button, a vend cycle will deliver a selected beverage can at the vend machine's delivery stage 15 according to a known practice.

Having described this invention it is believed that those familiar with the art will readily recognize the novel advancement thereof over the prior art and will readily appreciate that while the same has been illustrated and described in association with a preferred embodiment, the same is susceptible to variation, modification and substitution of equivalents without departing from the spirit and scope of this invention which is intended to be unlimited by the foregoing except as may appear in the following appended claims.

We claim:

1. An article display assembly, for use in coin-operated vending machines having an upright cabinet equipped with a front door and article selection means, comprising:

a planar display panel having a plurality of display openings therein closely receptive of articles to be displayed;

means for retaining said articles in display position in said openings so that only portions thereof protrude from one face of said panel;

means for mounting said panel within the interior of the cabinet door so that said portions of said articles mounted thereon are visibly displayed opposite a display window in the door's front panel, and artificial light means mounted within the door's interior and located outwardly adjacent said means for mounting said panel whereby to illuminate the displayed portions of said articles.

2. The display assembly of claim 1, and indicia on said display panel for identifying each article displayed with corresponding indicia of the article selection means.

3. An article display assembly, for use in coin-operated vending machines having an upright cabinet equipped with a hingedly mounted front door and article selection means, comprising:

a mounting frame, an opaque display panel extending across and supported by said frame;

said panel having the plurality of display openings therein each receptive of an article to be displayed;

means for retaining the articles in display positioned in said openings;

means for mounting said frame within the interior of the cabinet door so that said display panel is disposed in spaced relation behind and opposite a transparent display window mounted in the door's front panel, and plural light transmitting shields supported by said frame to border said display panel and extend between the latter and the inside face of the door's front panel, said light shield serving to indirectly transmit light from artificial light means located outwardly thereof with the door's interior whereby to illuminate the displayed articles.

4. The display assembly of claim 3, wherein said frame and display panel are integral and rectangular, with said frame extending from the margins of said display panel and rearwardly of one face thereof.

5. The display assembly of claim 4, wherein said display panel openings are generally rectangular and the articles are generally cylindrical; the width of each said opening being less than the diameter of an article therein and the axial length of an article being slightly less than the height of a said opening, whereby only a cylindrical segment of an article is insertable into a said opening for display beyond said one face of said panel.

6. The display assembly of claim 3, wherein said means for retaining said articles in said openings comprise tensions spring means extending across and adapted to engage the rearward sides of the articles mounted in said display panel openings for resiliently holding the same in place.

7. The display assembly of claim 3, wherein said display panel openings are arranged in horizontal rows having at least three openings in each row; the intermediate of said openings being narrower than the end openings of each row, whereby articles mounted in said intermediate openings protrude rearwardly of said panel a greater distance than the same size articles mounted in said end openings; and said means for retaining said articles comprises tension spring means, extending across and engaging the non-displayed sides of the articles in each said row with substantially equal force.

* * * * *